United States Patent [19]

Gaiffier

[11] Patent Number: 4,552,528

[45] Date of Patent: Nov. 12, 1985

[54] CURRENT GENERATOR FOR THE SUPPLY AND DETECTION OF OPERATION OF A GAS BURNER AND CONTROL DEVICE APPLYING SAME

[75] Inventor: Albert Gaiffier, Le Puy, France

[73] Assignee: Societe Anonyme: Construction Electriques R.V., Saint Germain Laprade, France

[21] Appl. No.: 596,448

[22] Filed: Apr. 3, 1984

[30] Foreign Application Priority Data

Apr. 7, 1983 [FR] France ..... 83 05892

[51] Int. Cl.[4] ..... F23N 5/12

[52] U.S. Cl. ..... 431/25; 431/78; 340/579

[58] Field of Search ..... 431/1, 6, 12, 25, 66, 431/67, 69, 71, 73, 74, 80, 82, 78; 340/579; 307/117; 328/6; 363/16, 18

[56] References Cited

U.S. PATENT DOCUMENTS

| | | | |
|---|---|---|---|
| 2,379,873 | 7/1945 | Lange | 431/25 X |
| 2,684,115 | 7/1954 | Cairns, Jr. | 431/25 |
| 4,070,143 | 1/1978 | Matthews | 431/25 X |
| 4,077,762 | 3/1978 | Matthews | 431/25 X |
| 4,405,299 | 9/1983 | Serber | 431/25 X |
| 4,413,303 | 11/1983 | Cheary et al. | 431/25 X |
| 4,461,615 | 7/1984 | Inoue | 431/25 X |
| 4,474,548 | 10/1984 | Miyanaka et al. | 431/25 X |

*Primary Examiner*—Randall L. Green

*Attorney, Agent, or Firm*—Weingarten, Schurgin Gagnebin & Hayes

[57] ABSTRACT

The invention relates to a current generator for the supply and detection of operation of a gas burner wherein said generator is equipped with a transformer comprising: 1—a primary winding supplied from a D.C. supply source by way of an electronic switch controlled by a pulse generator, 2—a first secondary winding including a resistor-capacitor assembly, and reaching to at least one detection electrode for detecting the operation of a gas burner, and, 3—a second secondary winding supplying direct current to at least one electrovalve supplying fuel to the gas burner. The invention finds an application in gas burners used in kitchen cookers.

5 Claims, 3 Drawing Figures

CURRENT GENERATOR FOR THE SUPPLY AND DETECTION OF OPERATION OF A GAS BURNER AND CONTROL DEVICE APPLYING SAME

The present invention relates to means for controlling the fuel supply to a gas burner and for detecting the operation of such burner with a view to optionally stopping the gas fuel supply in cases of non-ignition or accidental disappearance of the flame.

The technical field covered by the invention is that of both domestic and industrial gas burners, which may be used in any apparatus or installations, as a source of heat.

Controlling the operation of gas burners of the above type necessitates to use means capable of performing two functions.

The first function requires technical means for controlling the fiuid gas supply. This is generally adequately done by an electrovalve mounted on the pipe supplying ignition fluid to the burner.

Said electrovalve may be relay-controlled. But this is not altogether satisfactory insofar as a relay is not guaranteed to perform an automatic stoppage. Indeed, the contacts in a relay are liable to become welded together in a working position, in which case it becomes impossible to control the closure of the valve.

An electrovalve may also be controlled by a semiconductor converter. Such a device, however, is delicate and only has a low output power which is often inadequate for a repeated control of the electrovalve.

Another possibility is to use a transformer. The advantage of this is to isolate the electrovalve from the power control circuit and thus establish a positive safety. But this solution is impracticable because too expensive especially in the case of an installation with more than one gas burner.

The second function which is required is that of detection of the presence or absence of a flame at the burner. Detection can be carried out by the principle of conduction, using the conductive nature of a flame to convey a current between an electrode known as detection electrode and the earthed body of the burner.

Such principle effectively enables to detect the presence of a flame but it has proved unreliable with time. For example, the mere presence of a conducting impurity can easily simulate a flame and in doing so give a wrong result.

It is also possible to resort to detection by ionization, based on the same principle as above, but with a rectifying effect. This is much more reliable but has the disadvantage of necessitating from the user or the fitter a voltage-neutral connection which, if not observed, invariably leads to wrong results.

One way to overcome the aforesaid disadvantage is to use an insulating transformer between the detection system and the supply. But this is expensive.

Another detection means uses photo-sensitivity, namely a sensitive cell tuned on the infrared wavelength emitted by the flame of the burner.

This principle however is rarely applied at the moment as it has proved very expensive and difficult to use.

To sum up, controlling the operation of a burner requires the use of two separate systems which are mostly expensive and not very reliable.

It is the object of the present invention to overcome the aforesaid disadvantages by proposing a new generator for controlling the fuel supply and detecting operation of a gas burner, of the type designed to perform the two aforesaid functions, with its own constitutive elements.

One object of the invention is to propose a new generator which, on its own, is considerably cheaper than the installations currently known and used to perform the same duties.

Another object of the invention is to propose a current generator which is reliable and massproduceable for an advantageous cost price.

Yet another object of the invention is to propose a new generator of ready and convenient use without major alterations, for the control of fuel supply and detection of operation in one or more burners requiring separate and/or simultaneous control.

And a final object of the invention is to propose a new current generator capable of guaranteeing a positive safety in any cases of failure of any of its constituents.

These objects are reached according to the invention with a generator of the type using a transformer, and comprising:

- a primary winding supplied from a D.C. supply source by way of an electronic switch controlled by a pulse generator,
- a first secondary winding including a resistor-capacitor assembly, and reaching to at least one detection electrode for detecting the operation of a gas burner, and
- a second secondary winding supplying direct current to at least one electrovalve supplying fuel to the gas burner.

The invention also covers a control device for an installation equipped with at least one gas burner.

The invention will be more readily understood on reading the following description with reference to the accompanying drawings in which.

Figure 1:
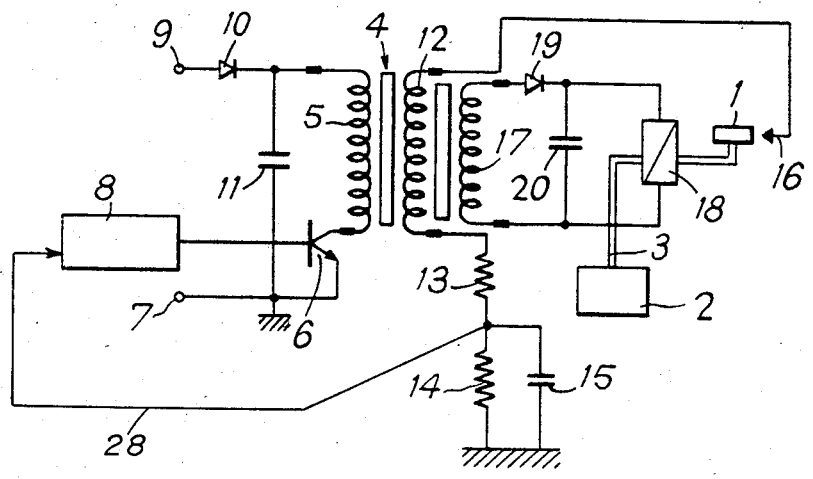
FIG. 1 is a diagrammatical view of the current generator according to the invention.

Referring first to FIG. 1, this shows a current generator for supplying a gas burner, such as 1, which can be supplied in fluid fuel from a source 2 via a pipe 3, and comprises a transformer 4 whose primary winding 5 is connected by one of its terminals to a D.C. producing or dispensing source. The working principle of transformer 4 is observed by connecting the second terminal of the primary winding 5 to an electronic switch 6 situated before the terminal 7 of the current producing or supplying source. Said electronic switch 6 is preferably constituted by a transistor whose change of condition is controlled by a pulse generator 8 connected to the base of transistor 6.

The diagram according to FIG. 1 shows one possibility of construction whereby the terminal 7 is, with the terminal 9, part of a source of alternating current which is rectified and filtered by a diode 10-capacitor 11 assembly situated between terminals 7 and 9 and the connection terminals of primary winding 5. In this particular case, the invention uses a transformer selected so that its maximum output corresponds to a different supply frequency than the A.C. supply frequency, the aim being to establish a positive safety by non-operation for example in case of failure of diode 10 or of capacitor 11.

Transformer 4 comprises, according to the invention, a first secondary winding 12 of which one terminal is earth-connected via an assembly of resistors 13 and 14 with a capacitor 15. The other terminal of the secondary winding 12 is connected to a detection electrode 16 situated adjacent the earth-connected burner 1. Electrode 16 is preferably constituted so that the "flame present" function is a direct result from the ionization effect resulting from the presence of such a flame.

According to the invention, transformer 4 comprises a second secondary winding 17 whose function is to ensure a D.C. supply to an electrovalve 18 situated on pipe 3 between the source 2 and the burner 1. To this effect, second winding 17 is equipped, between its terminals and the electrovalve 18, with a diode 19-capacitor 20 assembly.

The generator described hereinabove works as follows:

Generator 8 controls, at a set frequency, the change of position of the electronic switch 6 controlling the supply to the primary winding 5, either from a D.C. source, such as proposed hereinabove, or from the source of alternating current rectified and filtered by assembly 10-11. The second secondary winding 17 of transformer 4 controls the supply of electrovalve 18 by causing the fluid fuel to flow between the source 2 and burner 1.

When the fluid fuel is ignited by any suitable means, the flame, kept up by the burner 1, enables, by ionization, to close, via electrode 16, the circuit of first winding 12, thus charging capacitor 15 to a negative value and having thus an information signal corresponding to the presence of flame at the burner 1 one ling 28 connecting the common point of resistors 13, 14, and capacitor 15 to the pulse generator 8.

As explained in the foregoing, the generator according to the invention, being of compact design permits to use only one transformer and to perform, with all the guarantees of safety, the functions of, simultaneously, controlling the supply of fluid to a gas burner and detecting the presence of a flame at said burner.

One advantage of the present invention resides in the compact and reliable structure which procures to the user a lasting and safe-to-use equipment.

Another advantage of the present invention resides in the fact that the current generator can be given a third function which is to ignite the fluid fuel supplied to the burner 1.

Figure 2:
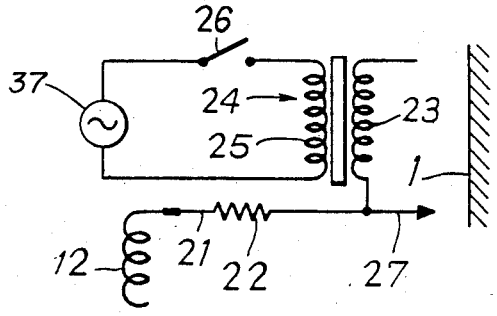
FIG. 2 is a diagrammatical view illustrating a variant embodiment of said generator.

Indeed, as illustrated in FIG. 2, the first secondary winding 12 can be extended beyond the connecting terminal by a conductor 21 provided with a resistor 22 and connected at one end of the secondary winding 23 of an ignition transformer 24, whose primary winding 25 can be connected to a source of electrical power 37 via a controlled switch 26. Said secondary winding 23 is connected on one side to an electrode 27 and on the other to the earth, via an auxiliary spark-gap. Said electrode is placed close to burner 1, as in the example described with reference to FIG. 1.

According to this variant embodiment, the generator can perform a further function. Indeed, after opening of electrovalve 18, switch 26 can be controlled to cause a spark, via winding 23, between electrode 27 and burner 1. The high voltage current produced by winding 23 has no effect in the transformer 4 because of the presence of clipping resistor 22. The produced spark ignites the fuel mixture issuing from the burner 1.

Supply to transformer 24 is then cut, via switch 26, so that electrode 27 can perform the same function as electrode 16 by permitting closure of the circuit of the first winding 12 when the flame of burner 1 allows conduction between said electrode and the burner.

Figure 3:
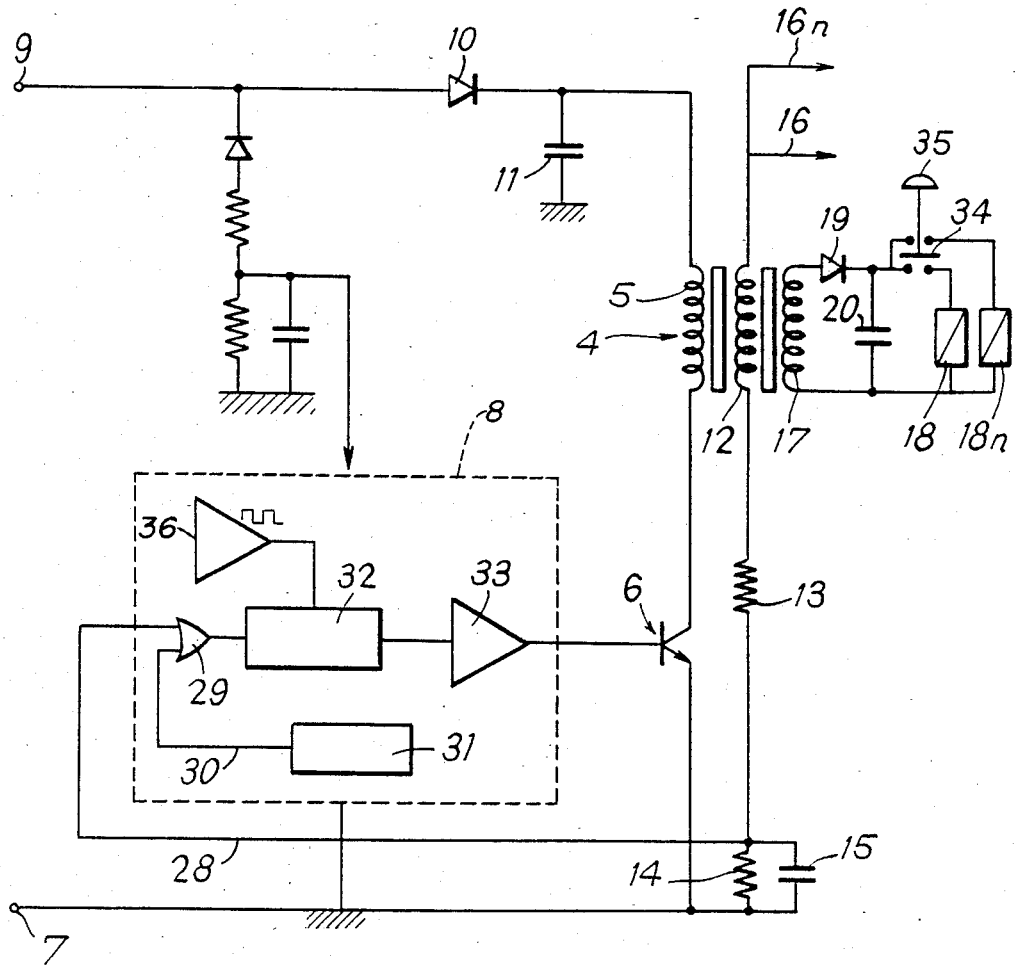
FIG. 3 is a diagrammatical view illustrating a control device for carrying out the object of the invention.

FIG. 3 gives a practical illustration of the structure of the device for controlling an installation containing at least one burner, the supply of which is controlled by a preset controlling or programming logic, with a safety setting in case of failures.

The signal corresponding to the charging of capacitor 15 is conveyed via conductor 28 to one of the inputs of an OR gate 29 whose other input is connected, via conductor 30, to an optionally adjustable timing assembly 31. The output of gate 29 is connected to the input of a logic unit 32 whose structure, operation or programmation characteristics are separate from the invention. Unit 32 is situated between the output of clock 36 and the base of transistor 6, whilst being placed upstream of an amplifier 33.

Thus, when energizing the device, timing assembly 31 operates unit 32, insofar as said unit allows the supply of transistor 6 by clock 36 and amplifier 33.

As previously, this causes the supply of transformer 4 and, as a result, the opening of electrovalve 18. In one way or another, ignition of the burner 1 is controlled so that electrode 16 causes the closure of the circuit of the first secondary winding 12 producing via capacitor 15 a signal applied to gate 29 to relay the timing assembly 31 and keep unit 32 operative.

If, after a predetermined period, ignition of burner 1 has not occurred for any reason, conductor 28 then supplies no signal to gate 29, so that supply to unit 32 is solely controlled by timing assembly 31, now operative for a pre-selected period after which the supply to transistor 6 is stopped, thus causing transformer 4 to become inoperative. In such a case, electrovalve 18 closes in order to stop the fuel supply to burner 1 and to re-set the inoperative conditions, thus offering complete safety to the users.

In cases where, after normal operation, there is sudden disappearance of the flame, then the circuit 28 delivers no information to gate 29. Unit 32 is then, either kept in a temporarily operative condition in case of possible re-ignition, or its supply is stopped altogether. In this latter case, transistor 6 stops receiving control pulses and then stops the supply to transformer 4. Electrovalve 18 then closes and stops the supply of fuel to burner 1.

An examination of FIG. 3 shows that the invention can guarantee positive safety since the supply to transformer 4 is stopped in all cases of failure of any of its components forming part of the device.

FIG. 3 shows that the invention can be used to supply fluid fuel to more than one burners, for example by providing as many electrovalves **18*n* as there are burners. Said electrovalves 18*n* may be energized individually by transformer 4 via a switch 34 controlled by control means 35. The circuit of the first secondary winding 12 may, in this case, contain as many electrodes 16*n* attached to the corresponding burners, which electrodes 16*n* can optionally be replaced, in the structure according to FIG. 2, by electrodes 27** which are, successively, igniting and detecting electrodes.

The invention is in no way limited to the description given hereinabove and on the contrary covers any variant that can be brought thereto without departing from the scope thereof.

What I claim is:

1. A fuel ignition means to provide an ignited flame comprising:

a transformer having a primary winding and a first and a second secondary windings;

energization means for providing a periodic excitation signal to said primary winding and gated by a gating signal;

flame probe means positioned at least partially within said flame connected to one end of said first secondary;

resistive return means connected to the other end of said first secondary, wherein at least part of said resistive return includes a capacitor connected thereacross, providing said gating signal to said energization means;

fuel valve for controlling the fuel flow; and means to energize said fuel valve connected to said second secondary, wherein the presence of said flame provides a gating signal to enable said energization means, wherein energy is produced at the second secondary for energization of said fuel valve;

the absence of said flame inhibits the gating signal thereby inhibiting the flow of fuel.

2. A fuel ignition means as claimed in claim 1, wherein said energization means comprises:

an electronic switch connected in series with said primary winding;

a DC source for applying a DC voltage to said primary winding and said series connected electronic switch; and a control circuit for controlling said electronic switch, wherein said control circuit including a pulse generator and a control input for receiving said gating signal.

3. The fuel ignition means of claim 2, wherein said control circuit comprises:

an amplifier whose output is connected to said series connected electronic switch;

a logic unit placed between said pulse generator and said amplifier;

a timing circuit providing a timing signal; and an OR gate, said OR gate receiving said gating signal and said timing signal, and providing a control signal to said logic unit.

4. The fuel ignition means of claim 1, wherein said DC source comprises an AC source and rectifier means.

5. The fuel ignition means of claim 4, wherein said transformer is selected to have a maximum output for a frequency different from that of the alternating current of said AC source.

* * * * *